US006882597B2

(12) United States Patent
Kent

(10) Patent No.: US 6,882,597 B2
(45) Date of Patent: Apr. 19, 2005

(54) DEVICE FOR DISPLAYING TIME IN SELECTABLE DISPLAY PATTERNS

(76) Inventor: Dennis C. Kent, 21261 Mayfaire La., Apt. 201, Lexington Park, MD (US) 20653

( * ) Notice: Subject to any disclaimer, the term of this patent is extended or adjusted under 35 U.S.C. 154(b) by 0 days.

(21) Appl. No.: 10/655,347

(22) Filed: Sep. 5, 2003

(65) Prior Publication Data

US 2005/0052953 A1 Mar. 10, 2005

(51) Int. Cl.[7] ..... G04C 17/00; G04B 19/00
(52) U.S. Cl. ..... 368/239; 368/76; 368/223
(58) Field of Search ..... 368/10, 28–30, 368/76, 82–84, 223, 229, 239, 241–242, 368/327

(56) References Cited

U.S. PATENT DOCUMENTS

| | | | | |
|---|---|---|---|---|
| 3,775,964 A | | 12/1973 | Fukumoto | |
| 3,958,409 A | | 5/1976 | Manber | |
| 4,130,987 A | * | 12/1978 | Schickedanz | 368/29 |
| 4,370,068 A | * | 1/1983 | Han | 368/240 |
| 4,757,484 A | | 7/1988 | Pardo | |
| 4,872,150 A | | 10/1989 | Norman | |
| 4,920,524 A | | 4/1990 | Kotob | |
| 4,969,134 A | * | 11/1990 | Balderson | 368/239 |
| 5,008,870 A | | 4/1991 | Vessa | |
| 5,214,624 A | * | 5/1993 | Siebrasse | 368/82 |
| 5,228,013 A | * | 7/1993 | Bik | 368/223 |
| 5,247,492 A | * | 9/1993 | Pan | 368/79 |
| 5,526,327 A | | 6/1996 | Cordova, Jr. | |
| 5,636,185 A | | 6/1997 | Brewer et al. | |
| 5,694,376 A | | 12/1997 | Sullivan | |
| 5,818,798 A | | 10/1998 | Luchun | |
| 5,838,643 A | | 11/1998 | Reiner | |
| 5,896,348 A | | 4/1999 | Lyon | |
| 5,926,440 A | * | 7/1999 | Chien | 368/10 |
| 6,711,101 B1 | * | 3/2004 | Bornovski | 368/223 |
| 2002/0031051 A1 | | 3/2002 | Emami | |
| 2002/0196711 A1 | | 12/2002 | Guhl | |

FOREIGN PATENT DOCUMENTS

| | | |
|---|---|---|
| DE | 4111415 | 10/1992 |
| DE | 4135514 | 2/1993 |
| DE | 4134709 | 4/1993 |
| JP | 2002-98782 | 4/2002 |

* cited by examiner

*Primary Examiner*—Kamand Cuneo
*Assistant Examiner*—Jeanne-Marguerite Goodwin
(74) *Attorney, Agent, or Firm*—Richard C. Litman

(57) ABSTRACT

The device for displaying time in selectable display patterns includes a storage device, an interface, a housing, display elements, and a controller. The storage device stores selectable display patterns. The interface receives an input to select a display pattern. The housing contains a display area that displays the selected display pattern. The display elements may include hour display elements, minute display elements, second display elements, day display elements, date display elements, and/or month display elements. Time is displayed by the amount of display elements in the exhibiting state.

13 Claims, 17 Drawing Sheets

DEVICE FOR DISPLAYING TIME IN SELECTABLE DISPLAY PATTERNS

BACKGROUND OF THE INVENTION

1. Field of the Invention

The present invention relates generally to the representation and display of time. More specifically, the present invention relates to a device adapted for displaying time in the form of a selectable display pattern.

2. Description of the Related Art

Throughout history, people have tried to display time. First, there were primitive sundials, then mechanical clocks, and now digital clocks.

Children struggle to learn how to tell time when first exposed to either traditional mechanical clocks or digital numerical presentations of the time of day. Consequently, a need has been felt for providing an alternative method of presenting information about the time of day that is customizable, flexible, changeable, and readily understandable. The present invention would be another means of telling time after the mechanical and digital timepieces in widespread use today.

U.S. Pat. No. 3,775,964, issued Dec. 4, 1973 to Fukumoto, describes a time-indicating apparatus using neither figures nor pointers, wherein the time-indicating plane is divided into the hour, minute and second indicating sections of a multiple of twelve and electric lamps or the like provided inside said sections are turned on or off by means of a switch connected to the clock mechanism to indicate the time by illuminating said sections successively.

U.S. Pat. No. 3,958,409, issued May 25, 1976 to Manber, describes a watch display including first and second concentric circular arrays of light emitting diodes which are sequentially energized to indicate the minutes and hours such that only one diode from each array is energized at any one time.

U.S. Pat. No. 4,757,484, issued Jul. 12, 1988 to Pardo, describes a clock device having a hollow housing bearing readily viewable adjacent first, second and illuminatable display panels. The first panel bears the hour display element and an inverted V indicating zero, four dots indicating ones and two horizontal bars each indicating five. The second panel is the tens of minutes display element and bears four dots and one horizontal bar, while the fifth panel is the minutes display element and bears an inverted V, four dots and one horizontal bar. The device can also include a similar temperature measuring and display mechanism, with separate fourth, fifth and sixth display panels bearing Mayan symbols, and + and − symbols, with switches to cause the device to alternately or simultaneously display the time and temperature.

U.S. Pat. No. 4,872,150, issued Oct. 3, 1989 to Norman, describes an apparatus for conveying time and date information by way of at least one array. Each array contains at least one pictorial image presented on a plane having no visible fittings, and each of the pictorial images has no meaning attached to its shape but by its presence in an array indicating the integer 1 and by one of its absence and its diminishment indicating the integer 0. Each of the arrays represents a binary number indicating at least one of seconds, minutes, hours, days of the week, days of the month, months, seasons and years. The image in the array is positioned relative to a reference not forming part of the array and not forming part of the image in the array not withstanding the presence, absence or diminishment of other images in any array.

U.S. Pat. No. 4,920,524, issued Apr. 24, 1990 to Kotob, describes a timepiece such that the dial of the timepiece is provided with a first circular array of twelve blue LEDs indicating hours, a second next-outermost array of sixty red LEDs indicating minutes, and a third next-outermost array of sixty green LEDs indicating seconds. Every fifth red "minute" LED is distinct from the intermediate "minute" LEDs in that it is either spaced farther apart from the adjacent LEDs or is larger than the adjacent LEDs, or both. A switch is provided in the timing circuit of the timepiece to select between a "normal" mode of operation wherein the sixty "minute" LEDs are energized in sequence, at the passage of each minute and a "teaching" mode of operation wherein only every fifth "minute" LED is energized, in sequence, at the passage of each five minute interval.

U.S. Pat. No. 5,008,870, issued Apr. 16, 1991 to Vessa, describes an electronic timepiece having a display with a center position and twelve columns. Each column has at least five display elements extending in a radial direction from the center position. The display elements of each column define at least five concentric rows. One of the rows defines a five minute hand row and another row defines an hour row. The minutes are displayed along each radial column to represent time periods of from one to four minutes with the fifth being indicated by the five minute display elements.

U.S. Pat. No. 5,228,013, issued Jul. 13, 1993 to Bik, describes a microelectronic-based timekeeping apparatus having several display means that change color to indicate the time-of-day, and user accessible switches for setting modes of operation. The apparatus and switches are mounted within an aluminum frame.

U.S. Pat. No. 5,526,327, issued Jun. 11, 1996 to Cordova, Jr., describes a display and method for depicting the passage of time by selectively and progressively filling predetermined areas, where each area represents hours, minutes, seconds and tenths of seconds, respectively. The areas may be of any shape or combination of shapes. The portion of the area that is filled represents that portion of an hour, minute, second or tenth of second that has passed. The areas may be normally dark in which case filling illuminates the area, or may be normally light in which case filling darkens the area. The areas may be arranged in unconventional and discontinuous patterns and incorporated into a wide variety of objects.

U.S. Pat. No. 5,636,185, issued Jun. 3, 1997 to Brewer, et al., describes a dynamically changing, multi-color liquid crystal display for electronic watches or other design apparel items. The display can be adapted to provide various colored images such as geometric images, animation images, customized images, designer labels, logos, etc. on colored backgrounds or, alternatively, provides a color changing capability that is aesthetically pleasing and fashionable. Moreover, the dynamically changing watch or other designer apparel item allows for the electronic control of the color appearance of the liquid crystal display as well as electronic control of the liquid crystal display images, such images being generally independent of the time of day.

U.S. Pat. No. 5,694,376, issued Dec. 2, 1997 to Sullivan, describes a method and device for displaying time using a single segment member where the length and position of the segment member reflects the time. The device generally comprises a timer circuit to set and maintain hours and minutes of time, and a segment member control circuit which is responsive to the timer circuit and adjusts the length and position of the segment member to reflect the time maintained by the timer circuit.

U.S. Pat. No. 5,818,798, issued Oct. 6, 1998 to Luchun, describes a timepiece having a novel display with an integral alphanumeric display, which includes alternating light and dark bands to assist in the determination by a user of the current time. The display includes two columns of a dozen hourly display elements each for indicating the current hour. Located around the perimeter of the display is a ring of sixty minute display elements. The timepiece includes a message receiver for decoding conventional paging protocols received through an RF antenna.

U.S. Pat. No. 5,838,643, issued Nov. 17, 1998 to Reiner, describes a timepiece comprising a face having a polygonal configuration when viewed in plan and a timekeeping mechanism coupled with the face. Means for indicating the hour of time, the minute of the hour, the day of the month, and the seconds of the hour are provided along the sides of the polygon.

U.S. Pat. No. 5,896,348, issued Apr. 20, 1999 to Lyon, describes a novel method or convention of tracking and displaying the passage of time. Three groups of display elements are used and each group is distinguishable from the other two groups. Each display element is capable of displaying one of two states and can be readily switched between the two states. The first group consists of twelve display elements to indicate the hours. The second group consists of five display elements to indicate the passage of multiples of ten minutes. The third group consists of nine display elements to indicate the passage of minutes.

U.S. Patent Publication No. 20020031051, published Mar. 14, 2002 to Emami, describes a watch, wherein the time is represented by a plurality of display means that are individually activated or deactivated. The watch includes a first group of display means for the number of hours, a second group of display means for a first position of the number of minutes and a third group for the second position of the number of minutes. The display means in each group preferably form at least three subgroups, wherein the groups and subgroups are arranged in such a way that they can be separately and optically perceived and the amount of display means activated in a group correspond to a figure redisplaying the time.

U.S. Patent Publication No. 20020196711, published Dec. 26, 2002 to Guhl, describes a watch having a digital or analogue time display and a device for displaying Chinese depictions by means of a display element. The display element displays the twelve Chinese life symbols and is designed such that it visually reveals one life symbol in each case for a time period of two hours, the respectively visible depiction correlating with a specific time display.

German Patent No. 4,111,415, published October 1992, describes an apparatus that displays time in the usual hours, minutes and seconds format. A quinary system of indication is used with a matrix of identical illuminated units. A right-hand vertical column indicates the numbers 1 to 4, a central column indicates the numbers 5, 10, 15, and 20, and a left-hand column indicates the numbers 25 or 50 to complete a minutes/seconds display. The hours 1 to 24 are displayed in a separate 2 column matrix in similar quinary fashion.

German Patent No. 4,135,514, published Feb. 25, 1993, describes an apparatus having a main surface with a display element which is movable relative to it. The main surface represents a complete time cycle, for example, a day, and the display element is superimposed on it. The display element maybe brighter than, or a different color to the main surface, and shows the actual time.

German Patent No. 4,134,709, published Apr. 22, 1993, describes a method involving using a visual symbol to represent each decimal figure (0–9) in a single or multi-digit number, for example, by illuminating selected LEDs in rows redisplaying hours, minutes, seconds or days, months, years. The method may take account of decimal placing of the numbers.

Japanese Patent No. 2002-98,782, published Apr. 5, 2002, describes a method for color-coding the time into hours, minutes and seconds and displaying them by fourteen display windows. The time is displayed by display windows for hours, minutes, and seconds, a minute interpolation display window and a second interpolation window. In the display windows, for example, primary color LEDs are used, and red color for hour display, green color for minute display and blue color for second display are distributed to display the hour, the minutes in five minute units, and the seconds in five second units by lighting positions of respective colors. The minute interpolation display window represents minutes dividable by five minutes, such as five minutes, ten minutes, and fifteen minutes when not lighted, sequentially lights the next minute in white, the next minute in red, the next minute in green and the next minute in blue, and displays sixty minutes in one minute units together with the twelve display windows of five minute units.

None of the above inventions and patents, taken either singly or in combination, is seen to describe the instant invention as claimed. Thus, a device for displaying time solving the aforementioned problems is desired.

SUMMARY OF THE INVENTION

The present invention is a device adapted for displaying time in the form of a selectable display pattern. In a first embodiment, the device includes a storage device, an interface, a housing containing a display area, a plurality of display elements, and a display elements controller.

The storage device is adapted for storing a plurality of selectable display patterns, and may be contained within the housing. The selectable display patterns can be customized to the operator's and/or manufacturer's tastes or preferences.

The interface is adapted for accepting at least one input from the operator and/or manufacturer, and may be contained within or secured to the housing. In response to the input, the interface preferably communicates with the controller such that one of the selectable display patterns is selected.

The housing contains a display area or background that is adapted for displaying the selected selectable display pattern.

The plurality of display elements includes a plurality of hour display elements and a plurality of minute display elements located proximate to the display area. The plurality of display elements may further include a plurality of second display elements, a plurality of day display elements, a plurality of date display elements, and/or a plurality of month display elements located proximate to the display area.

The amount of display elements of the hour display elements being in an exhibiting state indicates an elapsed number of hours in a day. The amount of display elements of the minute display elements being in an exhibiting state indicates an elapsed number of minutes in an hour. The amount of display elements of the second display elements being in an exhibiting state indicates an elapsed number of seconds in a minute. The amount of display elements of the day display elements being in an exhibiting state indicates an elapsed number of days in a week. The amount of display elements of the date display elements being in an exhibiting state indicates an elapsed number of days in a month. The amount of display elements of the month display elements being in an exhibiting state indicates an elapsed number of months in a year.

The controller is in communication with a time mechanism, the storage device, and the interface, and may be contained within the housing. Also, the controller is in operable communication with the plurality of display elements. Further, the controller is adapted for receiving time signals from the time mechanism and, in response to the time signals, outputs display control signals to the plurality of display elements such that an hours group pattern, a minutes group pattern, a seconds group pattern, a days group pattern, a date group pattern, and/or a months group pattern, of the selected selectable display pattern are exhibited proximate to the display area.

Each of the group patterns of the selected selectable display pattern is of discrete and discernable contrast relative to the display area, and is visually distinguishable from one another.

A source of the exhibition of the plurality of display elements may be emitted light, reflected light, such as light reflected off of shutters, fluorescent light, or any illumination means or method.

In addition, the interface may be, or include, a pattern toggle member and/or a time display toggle member.

In the second embodiment, the device does not include the housing. Thus, the selected selectable display pattern is displayed or shown on a display area of a structure.

Furthermore, the device of the present invention is flexible in that it allows the operator and/or manufacturer to select another selectable display pattern when a different display pattern to be displayed is desired.

Accordingly, it is a principal object of the invention to provide a way of presenting information about the time of day that is customizable by an operator and/or manufacturer.

It is another object of the invention to provide a way of presenting information about the time of day that is customizable and changeable by an operator and/or manufacturer.

It is a further object of the invention to provide a way of presenting information about the time of day that is readily comprehensible by a viewer.

Still another object of the invention is to provide a way of presenting information about the time of day that is aesthetically appealing.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
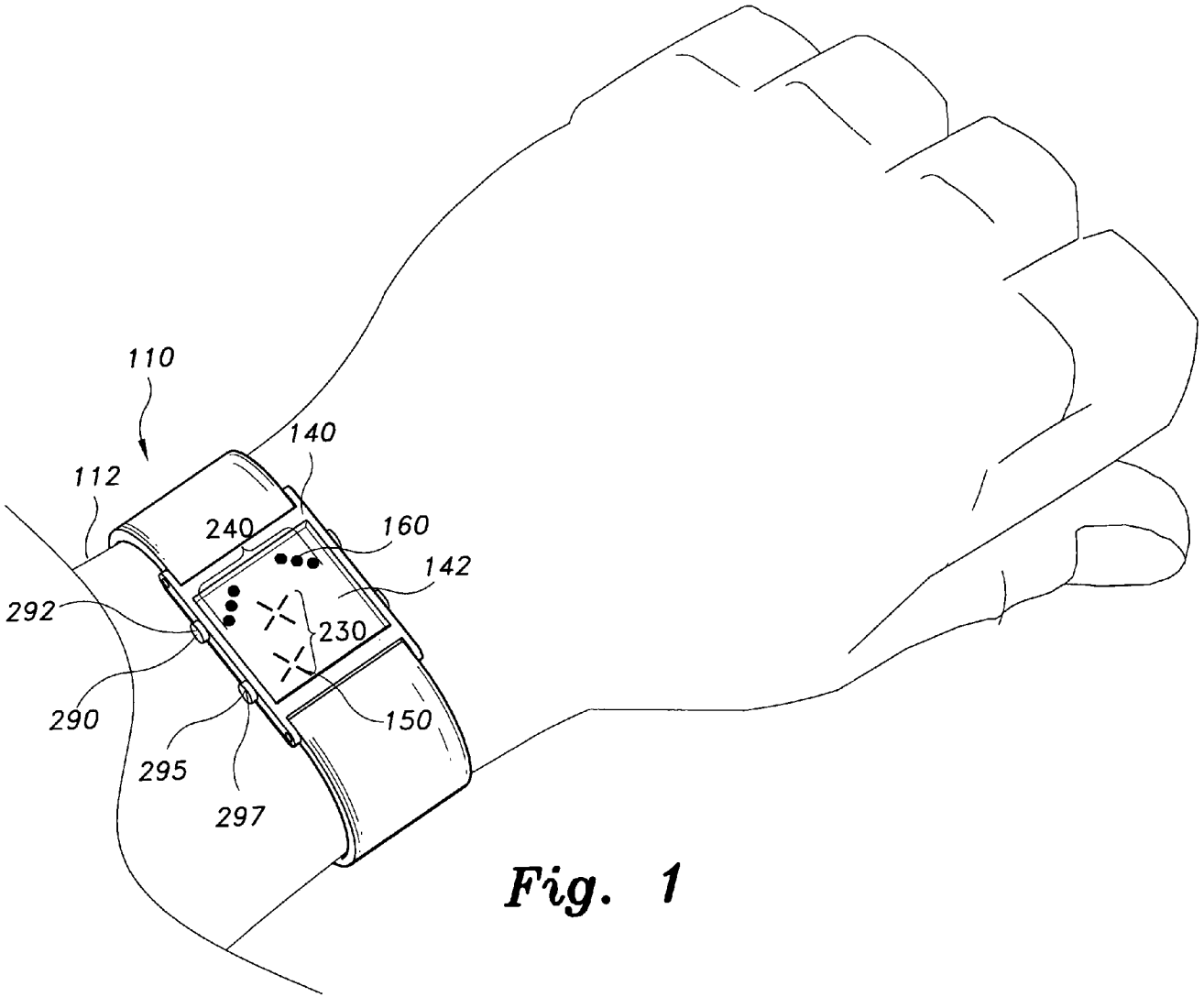
FIG. 1 is an environmental, perspective view of a device for displaying time according to the present invention, formed as a watch displaying time in hours and minutes.

Referring to FIGS. 1–16, the present invention is a device adapted for displaying time in the form of a selectable display pattern. In a first embodiment, the device 110 includes a storage device 120, an interface 130, a housing 140 containing a display area 142, a plurality of display elements, and a display elements controller 210. Examples of the first embodiment of the device 110 of the present invention are watches, wall clocks, desk clocks, digital bank clocks, clocks in automobiles and other types of vehicles, billboard type of clocks, such as one of the clocks located in Times Square in New York City, cellular telephones, personal computers, and any device, particularly related to electronics and/or communications, that includes a housing containing a display area and that desires to display or show time.

Figure 8:
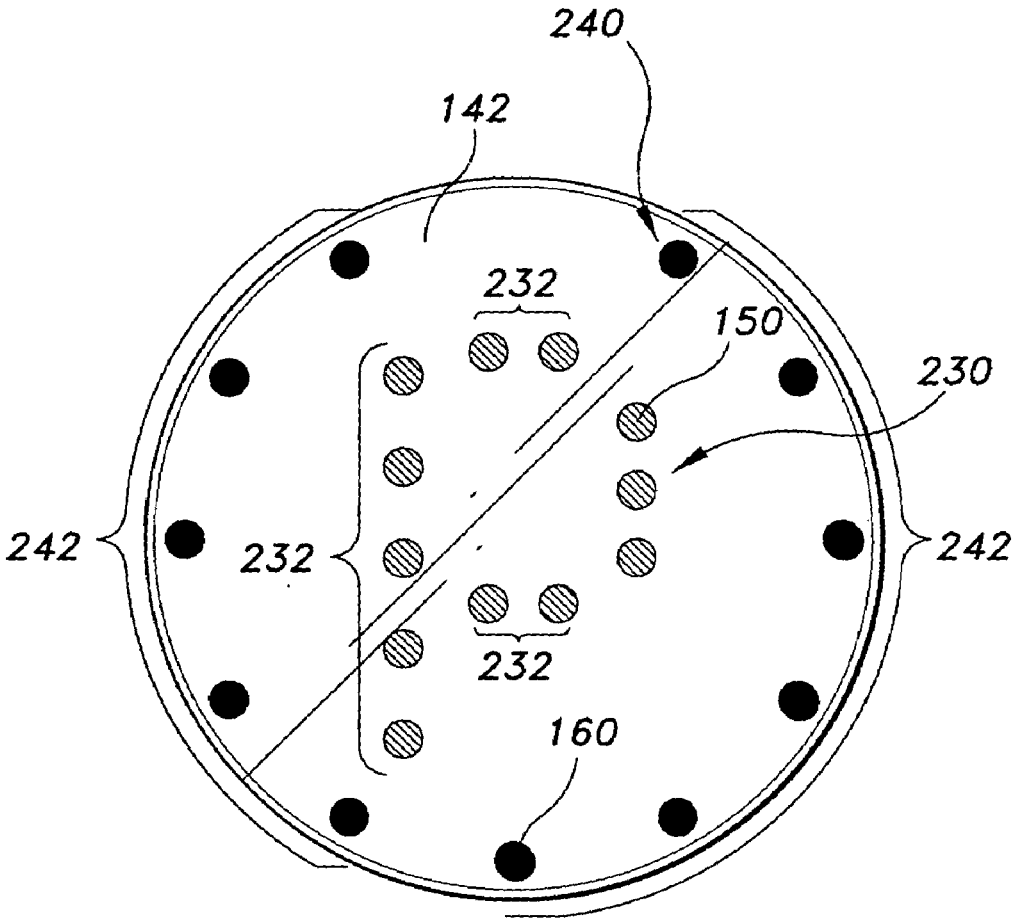
FIG. 8 is a top or front view of a device for displaying time according to the present invention, displaying time in the form of an hours group pattern and a minutes group pattern of another selectable display pattern.
Figure 9:
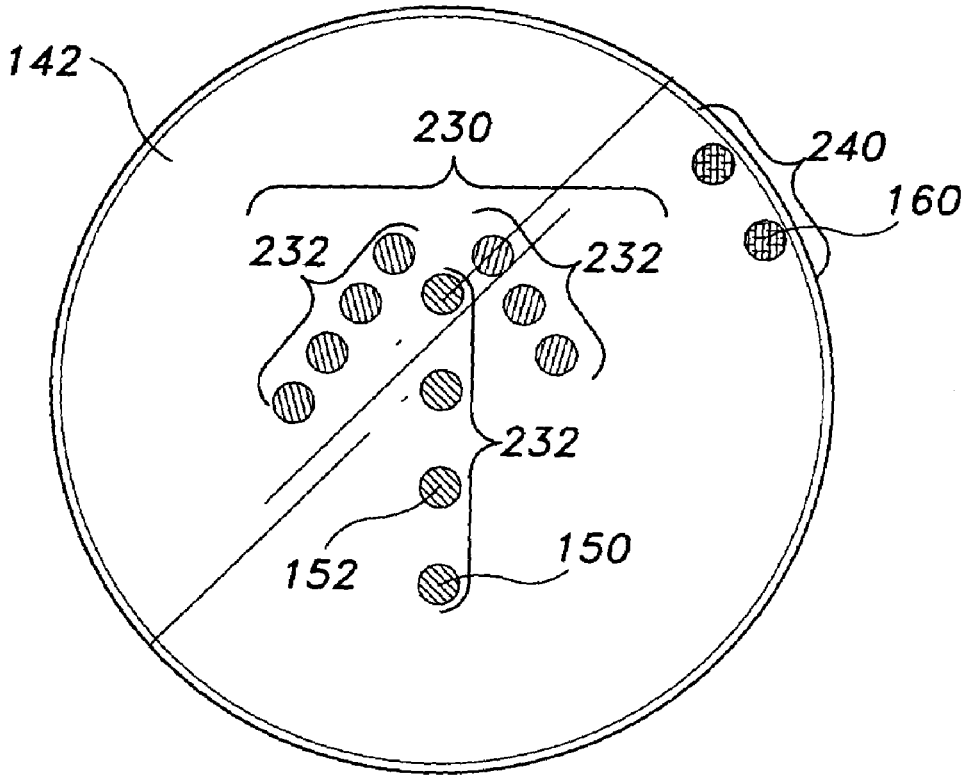
FIG. 9 is a top or front view of a device for displaying time according to the present invention, displaying time in the form of an hours group pattern and a minutes group pattern in A.M. time of another selectable display pattern.
Figure 10:
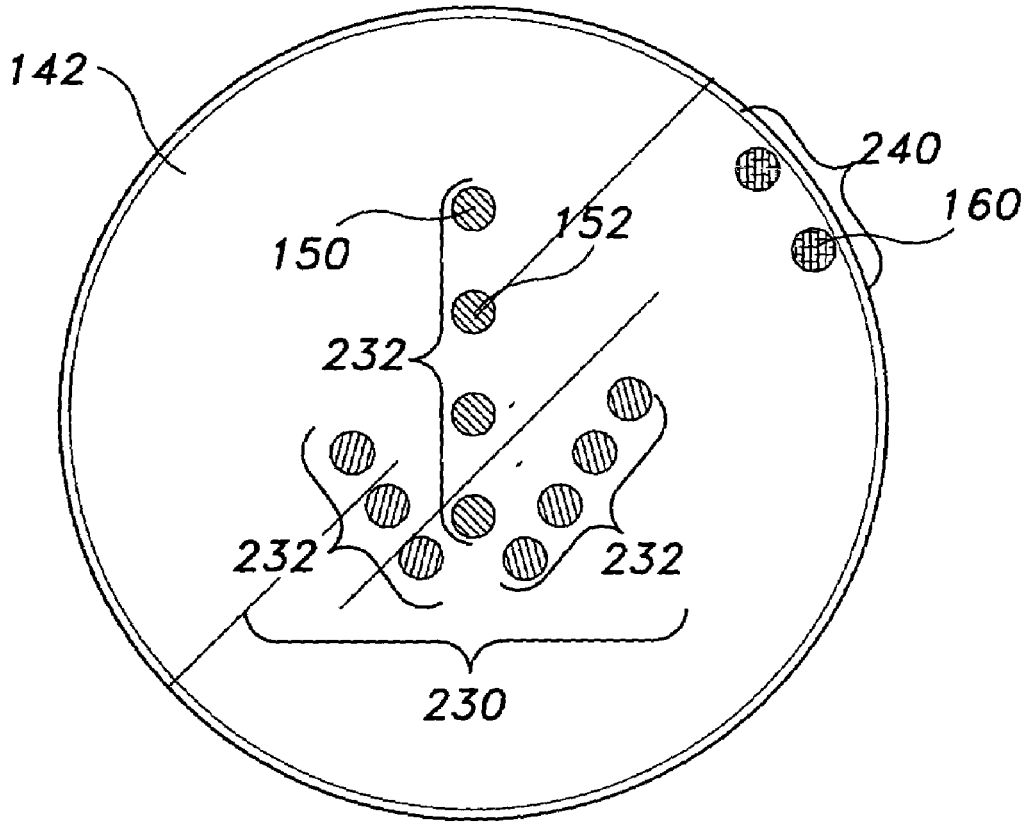
FIG. 10 is a top or front view of a device for displaying time according to the present invention, displaying time in the form of an hours group pattern and a minutes group pattern in P.M. time of the selectable display pattern of FIG. 9.
Figure 14:
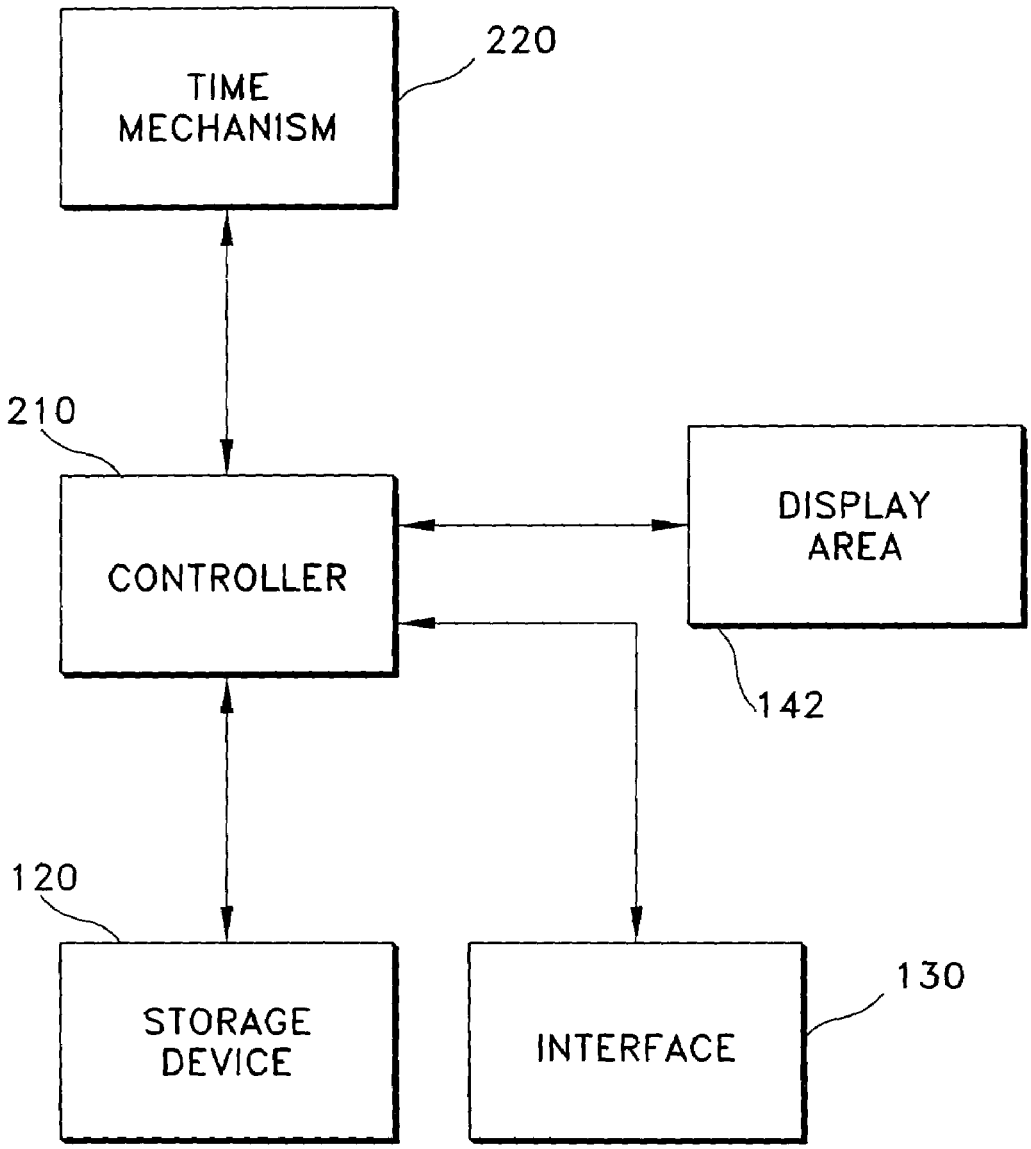
FIG. 14 shows a schematic of a device for displaying time according to the present invention.
Figure 15:
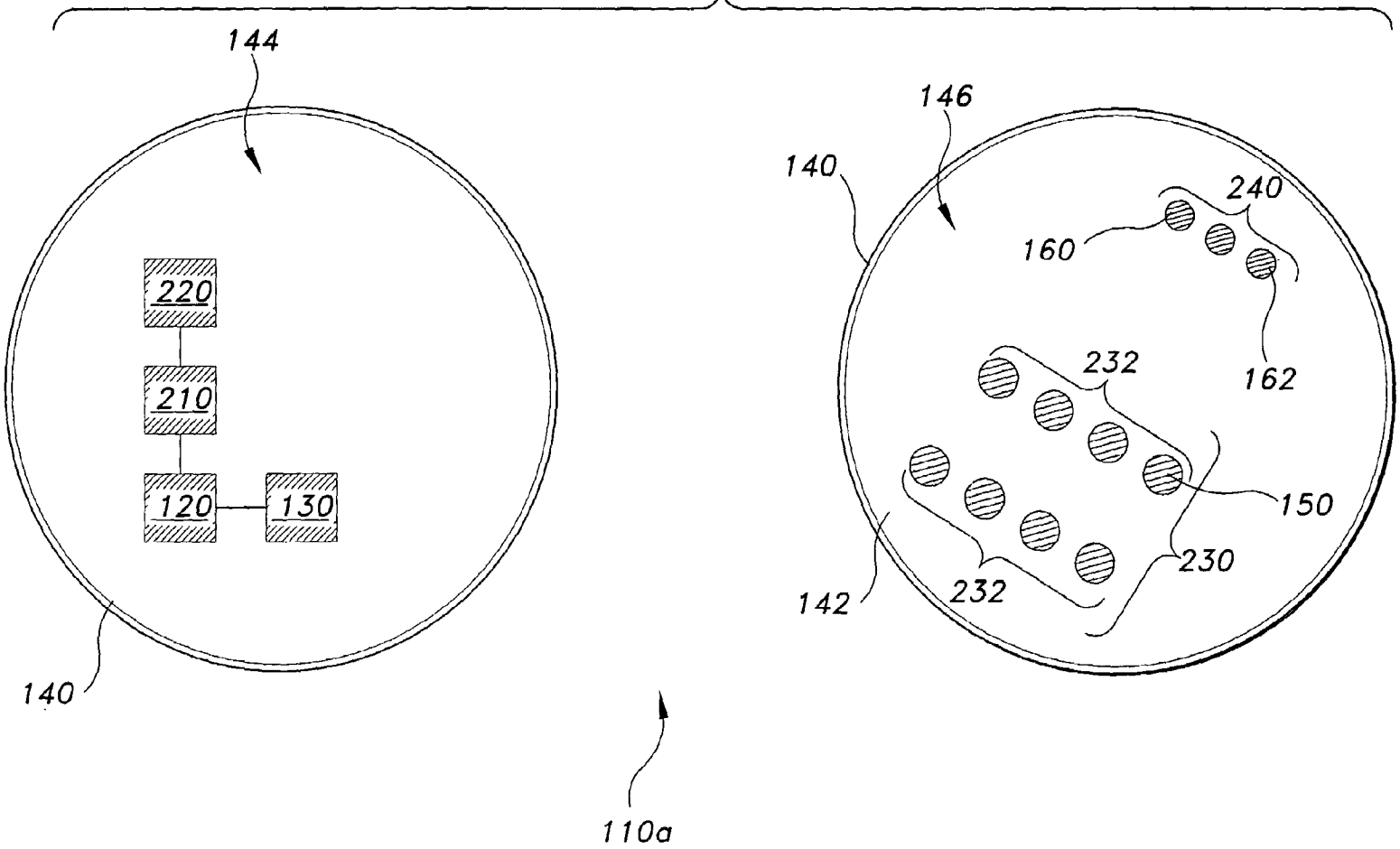
FIG. 15 shows the interior and exterior of a device for displaying time according to the present invention, as a watch displaying time in the form of an hours group pattern and a minutes group pattern of another selectable display pattern.

As shown in FIGS. 14 and 15, the storage device 120 is adapted for storing a plurality of selectable display patterns, and may be contained within the housing 140. The storage device 120 may be any known device known in the art that can store different selectable display patterns, which may have been programmed into or stored in the device by an individual user or operator 112 and/or manufacturer. The selectable display patterns can be customized to the operator's 112 and/or manufacturer's tastes or preferences, such as in the form of an upright pointed arrow (as shown in FIG. 9) indicating time in A.M. time, a downward pointed arrow (as shown in FIG. 10) indicating time in P.M. time, a sports ball, a cartoon character, or any other display pattern. Further, the operator 112 may prefer to customize the showing or display of time in a personal manner, such as depicting the first initial of their first and/or last name (as shown in FIG. 8).

As shown in FIGS. 14 and 15, the interface 130 is adapted for accepting at least one input from the operator 112 and/or manufacturer, and may be contained within or secured to the housing 140. In response to the input, the interface 130 preferably communicates with the controller 210 such that one of the selectable display patterns is selected. The interface 130 may be any known device known in the art.

As shown in FIGS. 1–7 and 15, the housing 140 contains a display area 142 or background that is adapted for displaying the selected selectable display pattern. Depending on what type of device the first embodiment of the present invention is manufactured as, the housing 140 may have one of a variety of different shapes and/or structures shown in FIGS. 1–7.

As shown in FIGS. 1, 2 and 4–16, the plurality of display elements includes a plurality of hour display elements 150 and a plurality of minute display elements 160 located proximate to the display area 142. The plurality of display elements may further include a plurality of second display elements 170, a plurality of day display elements 180, a plurality of date display elements 190, and/or a plurality of month display elements 200 located proximate to the display area 142. As examples, the plurality of display elements may be located on and/or below the display area 142. The plurality of display elements may be pixels of a liquid crystal display (LCD) or a light emitting diode (LED), and any other known display elements in the art.

Each hour display element 150 has at least an exhibiting state and a non-exhibiting state, and is for indication of 1 elapsed hour. As shown in FIGS. 1, 2, 4–12, 15 and 16, the amount of display elements of the hour display elements 150 being in the exhibiting state indicates an elapsed number of hours in a day. As examples, the number of hour display elements 150 may be 12 or 24 primary hour display elements 152.

Figure 5:
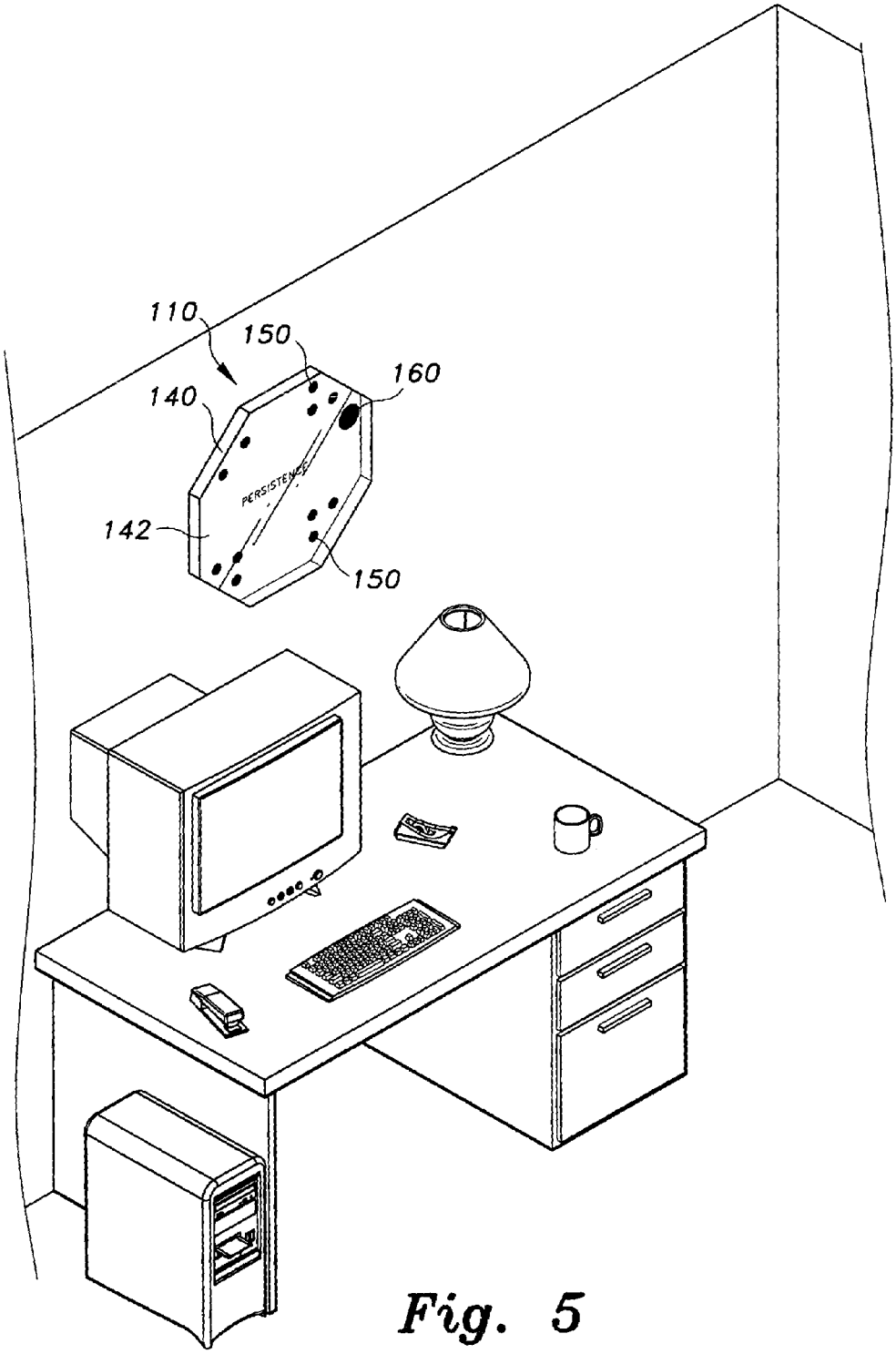
FIG. 5 is an environmental, perspective view of a device for displaying time according to the present invention, formed as a wall clock displaying time in hours and minutes.
Figure 6:
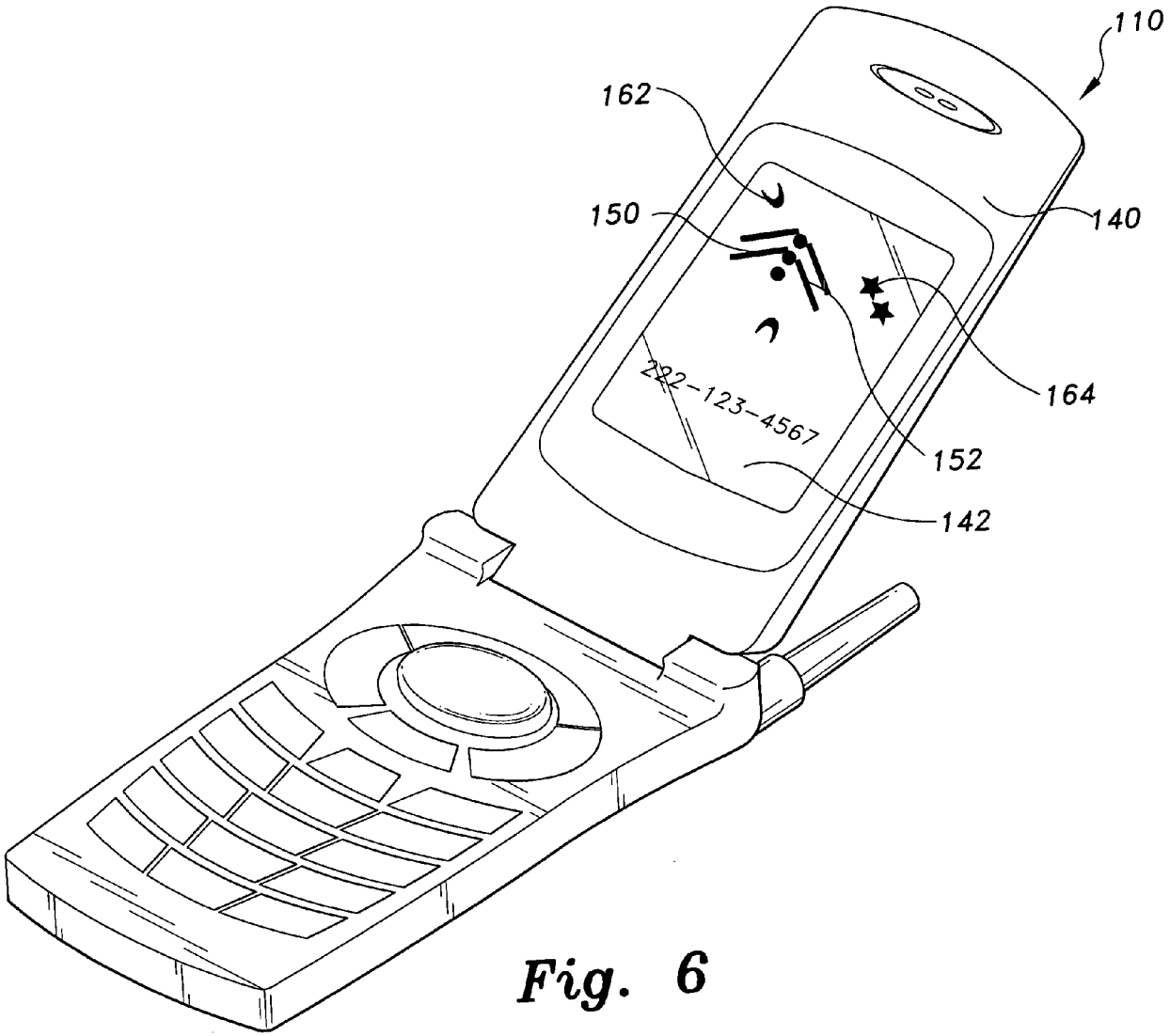
FIG. 6 is an environmental, perspective view of a device for displaying time according to the present invention, formed as a cellular telephone displaying time in hours and minutes.

Each minute display element 160 has at least an exhibiting state and a non-exhibiting state, and is for indication of at least 1 elapsed minute. As shown in FIGS. 5, 6, the amount of display elements of the minute display elements 160 being in the exhibiting state indicates an elapsed number of minutes in an hour. As examples, the number of minute display elements 160 may be 60 primary minute display elements 162 such that each primary minute display element 162 is for indication of 1 elapsed minute, 12 primary minute display elements 162 such that each primary minute display element 162 is for indication of 5 elapsed minutes, or 12 primary minute display elements 162 and 4 secondary minute display elements 164 such that each primary minute display element 162 is for indication of 5 elapsed minutes and each secondary minute display element 164 is for indication of 1 elapsed minute of a 4-minute period between each 5-minute interval.

Figure 12:
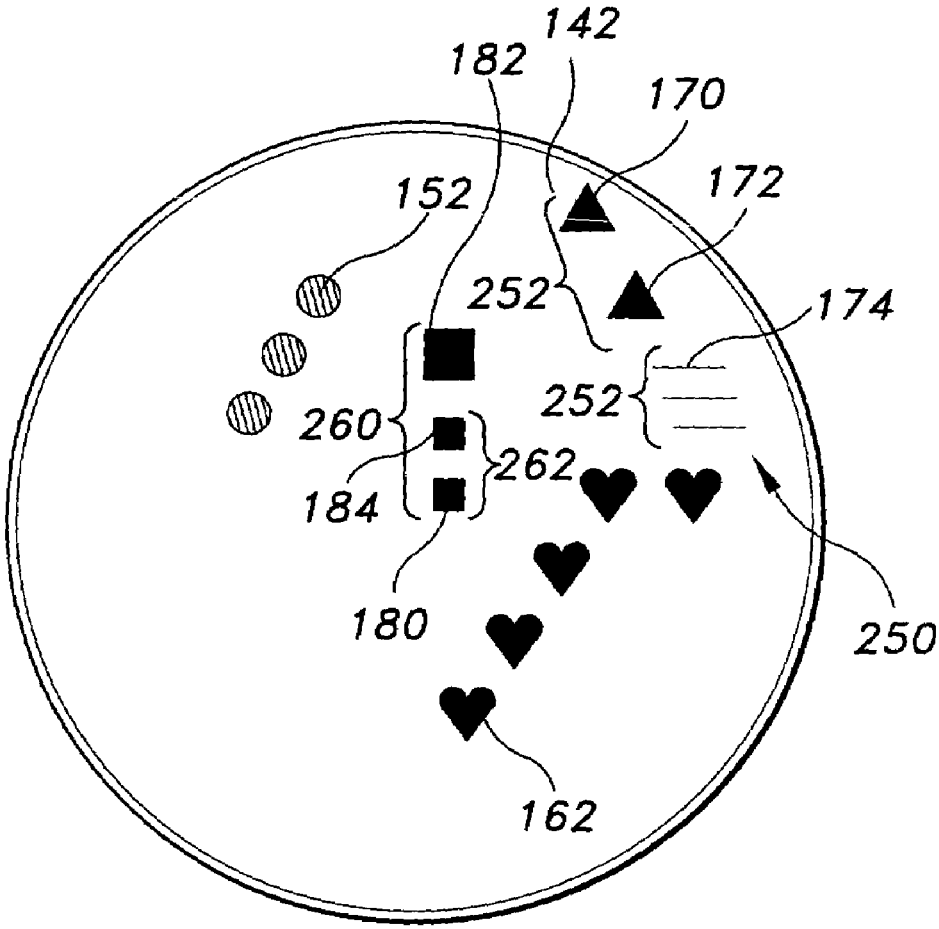
FIG. 12 is a top or front view of a device for displaying time according to the present invention, displaying time in the form of an hours group pattern, a minutes group pattern, a seconds group pattern and a days group pattern of another selectable display pattern.

Each second display element 170 has at least an exhibiting state and a non-exhibiting state, and is for indication of at least 1 elapsed second. As shown in FIG. 12, the amount of display elements of the second display elements 170 being in the exhibiting state indicates an elapsed number of seconds in a minute. As examples, the number of second display elements 170 may be 60 primary second display elements 172 such that each primary second display element 172 is for indication of 1 elapsed second, 12 primary second display elements 172 such that each primary second display element 172 is for indication of 5 elapsed seconds, or 12 primary second display elements 172 and 4 secondary second display elements 174 such that each primary second display element 172 is for indication of 5 elapsed seconds and each secondary second display element 174 is for indication of 1 elapsed second of a 4-second period between each 5-second interval.

Each day display element 180 has at least an exhibiting state and a non-exhibiting state, and is for indication of at least 1 elapsed day in a week. As shown in FIG. 12, the amount of display elements of the day display elements 180 being in the exhibiting state indicates an elapsed number of days in a week. As examples, the number of day display elements 180 may be 7 primary day display elements 182 such that each primary day display element 182 is for indication of 1 elapsed day, or 1 primary day display elements 182 and 4 secondary day display elements 184 such that each primary day display element 182 is for indication of 5 elapsed days and each secondary day display element 184 is for indication of 1 elapsed day of a 4-day period at the beginning of a week and, when in combination with the primary day display element 182 in the exhibiting state, of 1 elapsed day of the sixth and seventh days of the week.

Figure 2:
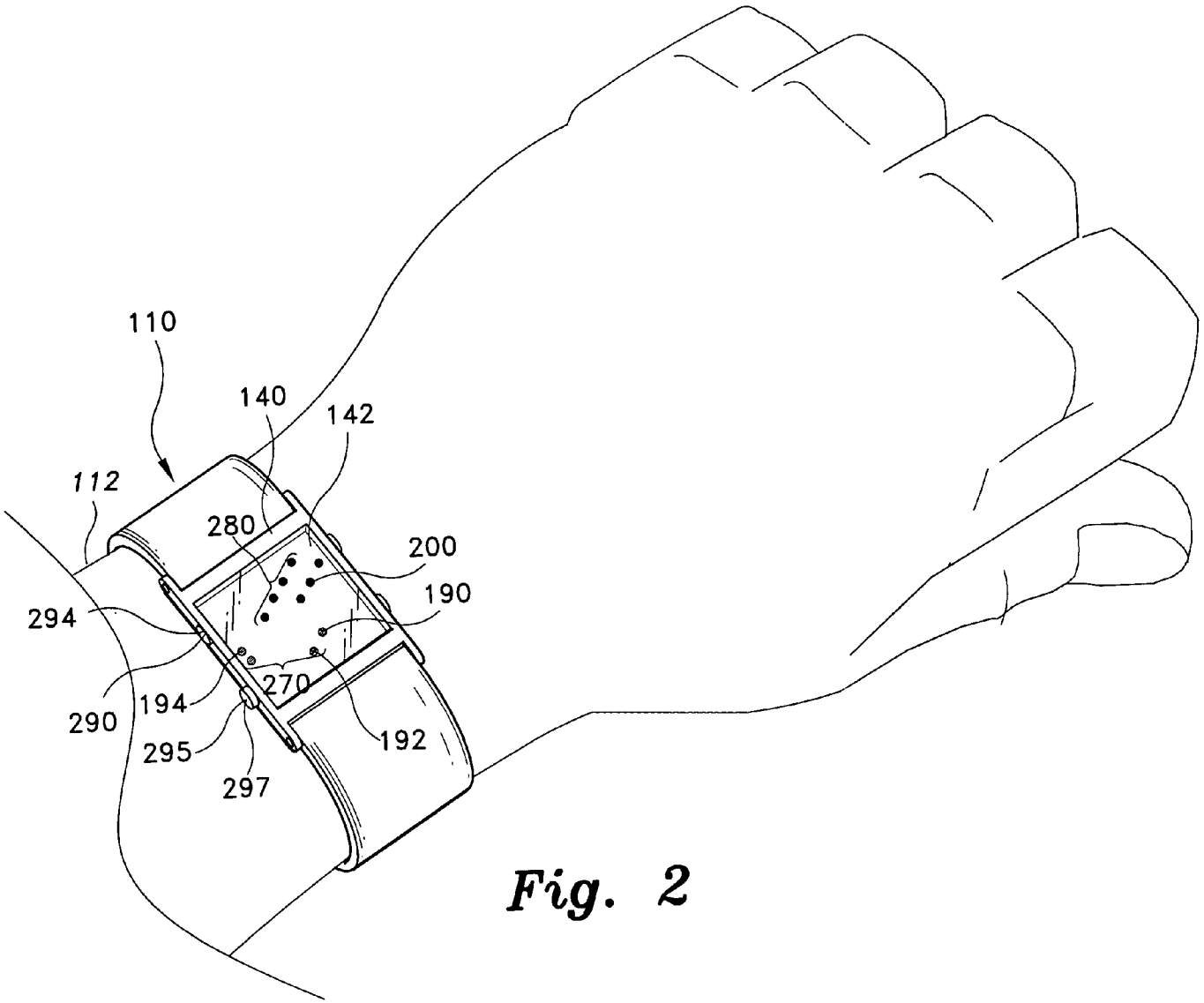
FIG. 2 is an environmental, perspective view of the device of FIG. 1 displaying the date and month.
Figure 13:
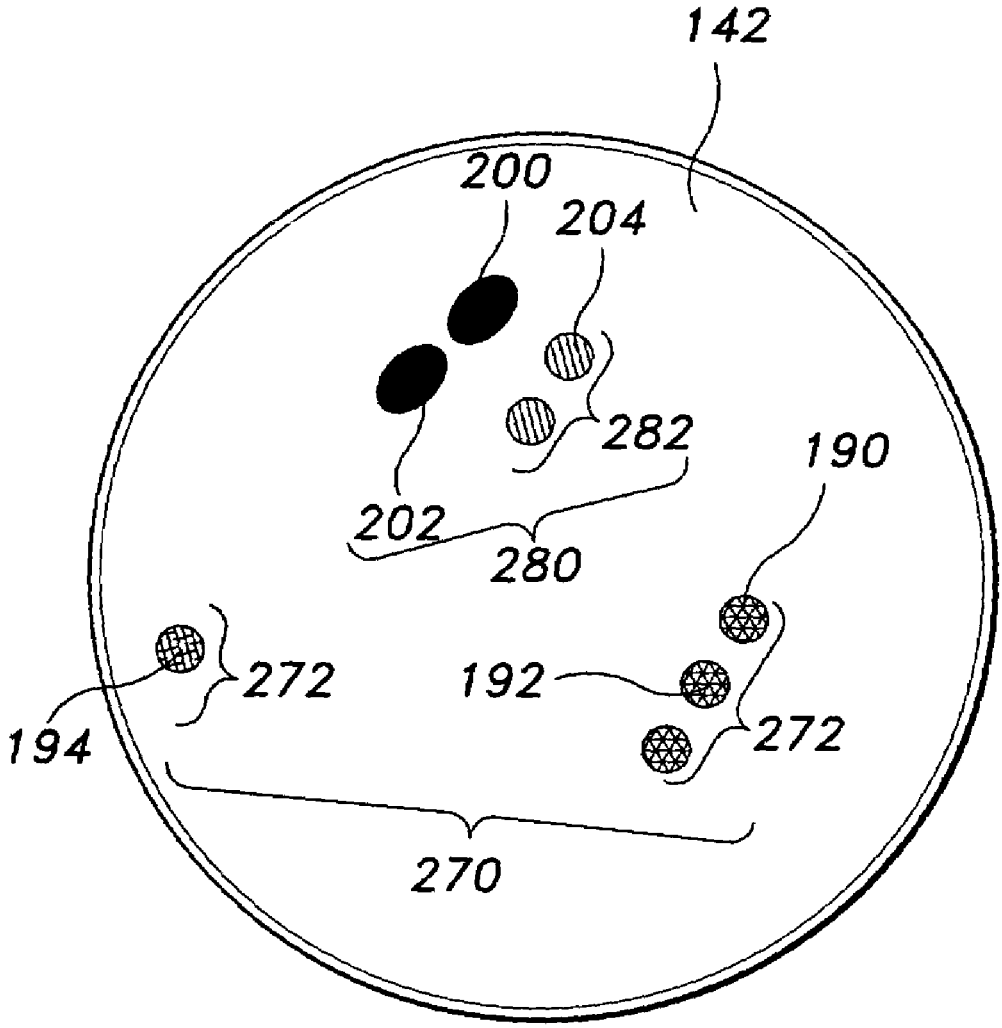
FIG. 13 is a top or front view of a device for displaying time according to the present invention, displaying time in the form of a date group pattern and a months group pattern of another selectable display pattern.

Each date display element 190 has at least an exhibiting state and a non-exhibiting state, and is for indication of at least 1 elapsed day in a month. As shown in FIGS. 2 and 13, the amount of display elements of the date display elements 190 being in the exhibiting state indicates an elapsed number of days in a month. As examples, the number of date display elements 190 may be 31 primary date display elements 192 such that each primary date display element 192 is for indication of 1 elapsed day in a month, or 6 primary date display elements 192 and 4 secondary date display elements 194 such that each primary date display element 192 is for indication of 5 elapsed days and each secondary date display element 194 is for indication of 1 elapsed day of a 4-day period between each 5-day interval and, when in combination with the 6 primary date display elements 192 in the exhibiting state, of 1 elapsed day of the thirty-first day of the month.

Each month display element 200 has at least an exhibiting state and a non-exhibiting state, and is for indication of at least 1 elapsed month. As shown in FIGS. 2 and 13, the amount of display elements of the month display elements 200 being in the exhibiting state indicates an elapsed number of months in a year. As examples, the number of month display elements 200 may be 12 primary month display elements 202 such that each primary month display element 202 is for indication of 1 elapsed month in a year, or 2 primary month display elements 202 and 4 secondary month display elements 204 such that each primary month display element 202 is for indication of 5 elapsed months and each secondary month display element 204 is for indication of 1 elapsed month of a 4-month period between each 5-month interval and, when in combination with the 2 primary month display elements 202 in the exhibiting state, of 1 elapsed month of the eleventh and twelfth months of the year.

Figure 4:
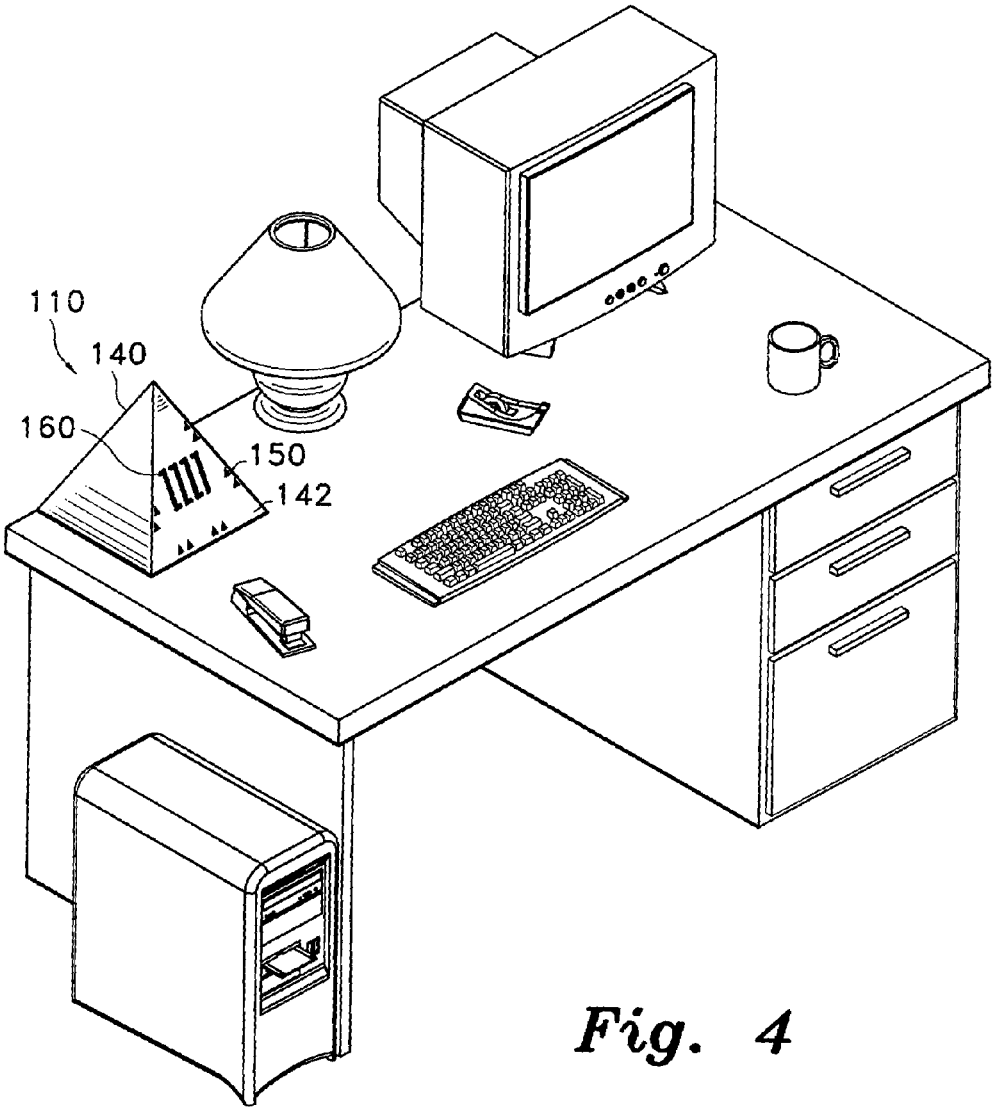
FIG. 4 is an environmental, perspective view of a device for displaying time according to the present invention, formed as a desk clock displaying time in hours and minutes.
Figure 7:
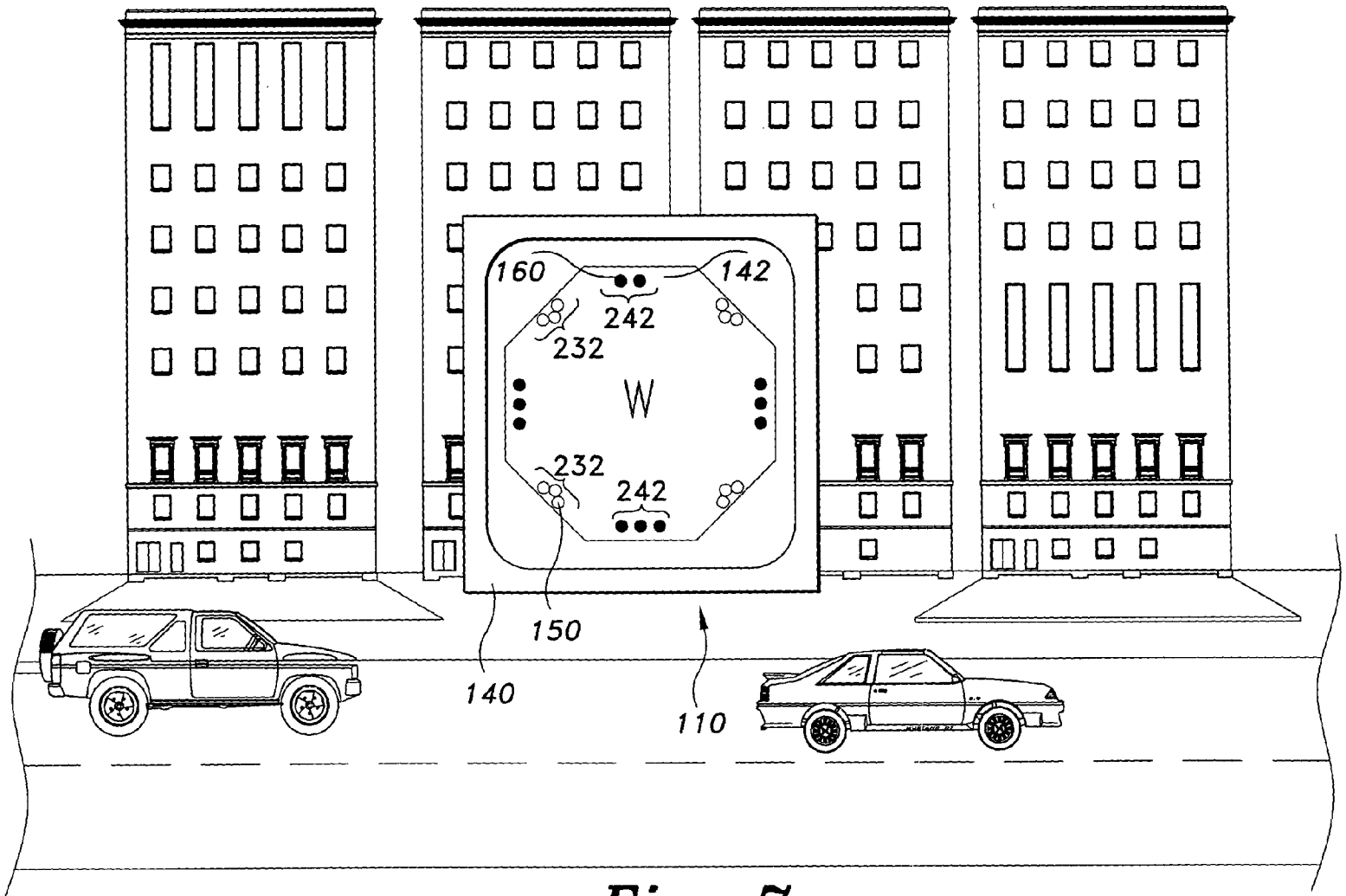
FIG. 7 is an environmental, perspective view of a device for displaying time according to the present invention, formed as a billboard type of clock displaying time in hours and minutes.
Figure 11:
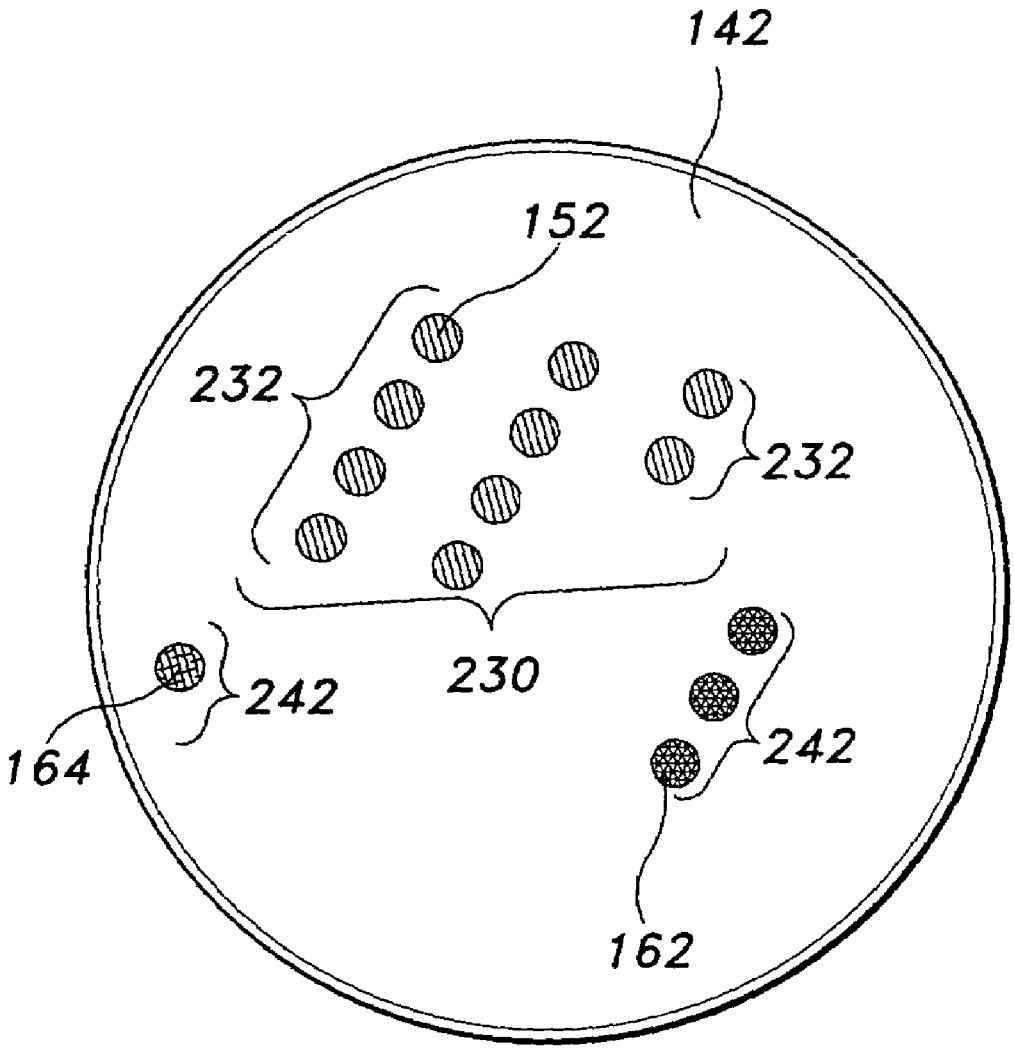
FIG. 11 is a top or front view of a device for displaying time according to the present invention, displaying time in the form of an hours group pattern and a minutes group pattern of another selectable display pattern.

As examples of the representation of time by the exhibition of the plurality of display elements in the exhibiting state, FIG. 1 shows that the time is 8 hours and 30 minutes. FIG. 2 shows that the date is July $12^{th}$. FIG. 4 shows that the time is 10 hours and 55 minutes. FIG. 5 shows that the time is 11 hours and 5 minutes. FIG. 6 shows that the time is 7 hours and 12 minutes. FIGS. 7 and 8 show that the time is 12 hours and 55 minutes. FIG. 9 shows that the time is 11 hours and 10 minutes A.M. FIG. 10 shows that the time is 11 hours and 10 minutes P.M. FIG. 11 shows that the time is 10 hours and 16 minutes. FIG. 12 shows that the time is 3 hours, 25 minutes and 13 seconds, and that the day of the week is the $7^{th}$ day or Sunday. FIG. 13 shows that the date is December $16^{th}$ FIG. 15 shows that the time is 8 hours and 15 minutes.

As shown in FIGS. 14 and 15, the display elements controller 210 is in communication with a time mechanism 220, the storage device 120, and the interface 130, and may be contained within the housing 140. Also, the controller 210 is in operable communication with the plurality of display elements 150,160,170,180,190,200 such that the controller 210 is adapted for switching each of the plurality of display elements 150,160,170,180,190,200 at least between the exhibiting state and non-exhibiting state of the respective display element 150,160,170,180,190,200. Further, the controller 210 is adapted for receiving time signals from the time mechanism 220 and, in response to the time signals, outputs display control signals to the plurality of display elements 150,160,170,180,190,200 such that an hours group pattern 230, a minutes group pattern 240, a seconds group pattern 250, a days group pattern 260, a date group pattern 270, and/or a months group pattern 280, of the selected selectable display pattern are exhibited proximate to the display area 142. FIG. 15 shows the interior 144 and exterior 146 of a preferred embodiment of the device 110 in the form of a watch 110*a*.

The controller 210 may be any known microprocessor integrated circuit including a process unit and memory. The memory may include random access memory (RAM), read only memory (ROM), erasable programmable ROM (EPROM) and a data storage memory. In a preferred embodiment, the controller 210 comprises a processor and internal memory wherein the software to control the controller 210 is stored on the internal memory. Also, the controller 210 may be an LCD controller, an LED controller, a shutters controller, or any known standard means of addressing or controlling the plurality of display elements, such as through software or hardware programming.

Each of the group patterns 230,240,250,260,270,280 of the selected selectable display pattern is of discrete and discernable contrast relative to the display area 142, and is visually distinguishable from one another. Also, as shown in FIGS. 7–13, 15 and 16, each of the group patterns 230,240, 250,260,270,280 includes a plurality of subgroup patterns 232,242,252,262,272,282 such that each subgroup pattern 232,242,252,262,272,282 is able to be initiated by any display element 150,160,170,180,190,200 within that particular subgroup pattern 232,242,252,262,272,282. Further, the chronological sequence of exhibition proximate to the display area 142 among the subgroup patterns 232,242,252, 262,272,282 of a group pattern 230,240,250,260,270,280 is able to be initiated by any display element 150,160,170,180, 190,200 within any one of the subgroup patterns 232,242, 252,262,272,282 of that group pattern 230,240,250,260,270, 280. The groupings and subgroupings of the display elements 150,160,170,180,190,200 are displayed in repeatable, recognizable patterns in relation to time. To facilitate rapid comprehension of the selected selectable display pattern by a viewer or the operator, each subgroup pattern 232,242,252,262,272,282 of each group pattern 230, 240, 250, 260, 270, 280 may be exhibited by 2 display elements to 6 display elements.

The group patterns 230,240,250,260,270,280 may be exhibited proximate to the display area 142 in a variety of different ways relative to the operator's 112 or manufacturer's tastes or preferences. As examples, the group patterns 230, 240, 250, 260, 270, 280 may be exhibited of different colors, different size dots, lines or shapes, different shaped dots, lines or shapes, and/or different spacing between dots, lines or shapes. The groupings of dots, lines, and/or shapes can be customizable into various groupings or patterns. The dots, lines and shapes can take any form, such as, circular, triangular, rectangular, square, non-uniform shape, straight, curved, dashed, etc., size, spacing, etc., as long as the dots, lines and shapes are discrete and discernable relative to the display area 142. The groupings of dots, lines and/or shapes can be changeable periodically, such as, daily, from A.M. to P.M., weekly, monthly, etc., or aperiodically, via the manufacturer or the individual owner through a software, hardware, a mechanical interface, or any other means or method known in the art, randomly, automatically, etc. The different ways in which the group patterns 230,240,250,260,270,280 may be exhibited may help to enhance the ability of the viewer or operator 112 to quickly and readily recognize and interpret time from the different group patterns 230,240,250, 260,270,280. This may also help to enhance the aesthetic qualities of the selectable display patterns. Also, a couple or several of the group patterns 230,240,250,260,270,280 may be programmed to combine and form a single display pattern.

As examples, a source of the exhibition of the plurality of display elements 150,160,170,180,190,200 may be emitted light, reflected light, such as light reflected off of shutters, fluorescent light, or any illumination means or method.

For simplicity and/or manufacturing preferences, the storage device 120, interface 130, plurality of display elements 150,160,170,180,190,200 and controller 210 may be integrated into fewer devices, such as being manufactured as a single operating device.

In addition, as shown in FIGS. 1 and 2, the interface 130 may include a pattern toggle member 290 that is able to be placed by the operator 112 in either of a first position 292 and a second position 294. When the pattern toggle member 290 is in the first position 292, a first display of at least one of the group patterns, such as the hours group pattern 230 and minutes group pattern 240, is displayed or shown. When the pattern toggle member 290 is in the second position 294, a second display of at least one of the other group patterns, such as the date group pattern 270 and months group pattern 280, is displayed or shown such that the first display and the second display are visually distinguishable from one another.

Alternatively, the toggle member 290 may be a momentary switch which successively scrolls through the toggle states. The toggle states may include a third toggle state, shown in FIG. 2A, in which both the date and time are displayed.

Figure 2A:
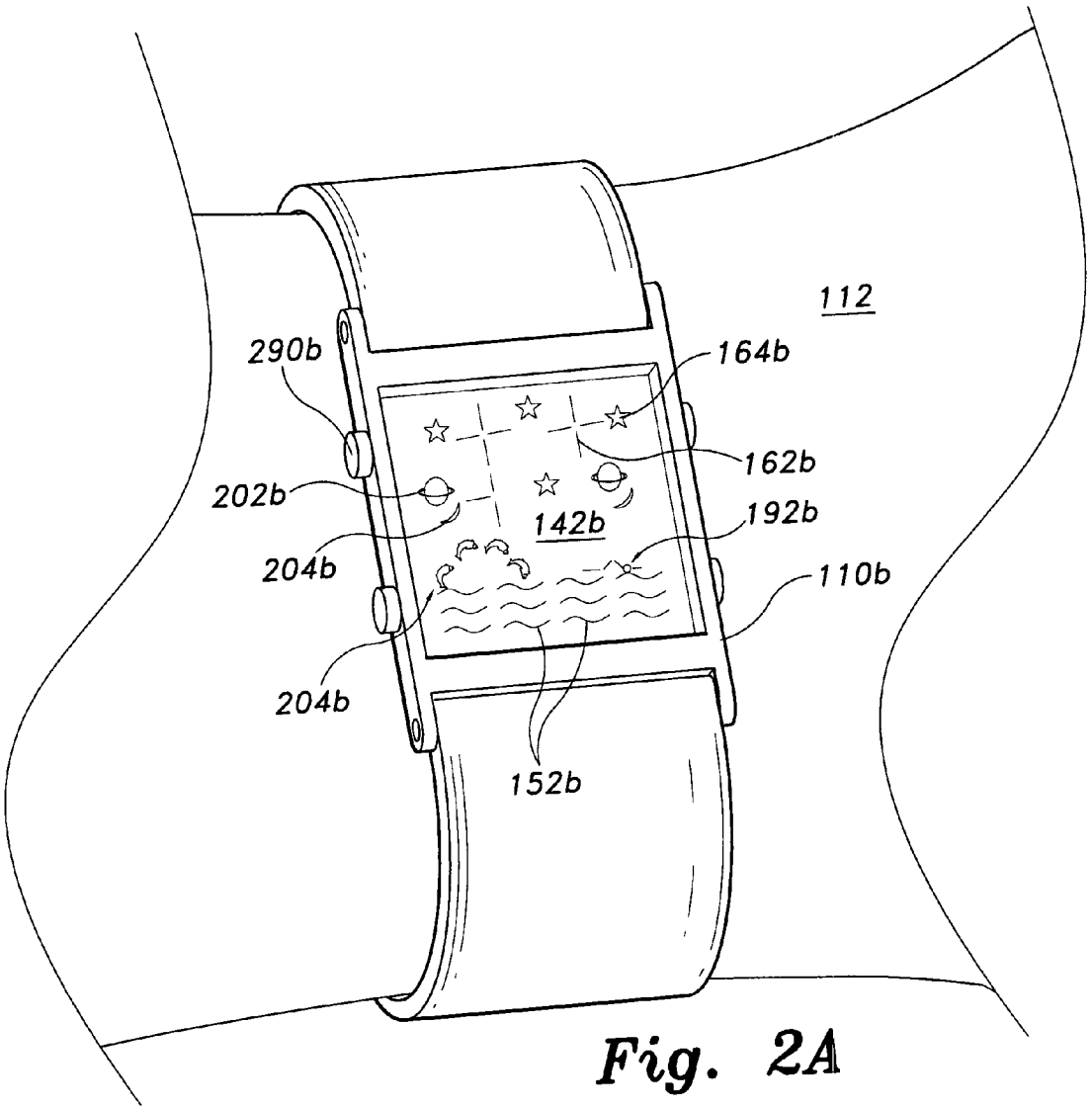
FIG. 2A is a fragmented, environmental perspective view of a watch similar to the device of FIG. 1, expanded to show a toggle state in which the display area shows both the date and time.

In FIG. 2A, the device is configured as a watch 110*b* with display area 142*b*. Toggle switch 290*b* is a momentary switch which causes the display to toggle between display states each time the switch 290*b* is depressed, the toggle states including a first state displaying only the time, a second state displaying only the date, and a third state showing both the date and the time. FIG. 2A is shown expanded to show details of the display. In this Figure, the date shown is December 29. The display elements corresponding to the month include the primary month symbol 202*b*, depicted as the planet Saturn, each occurrence of the Saturn symbol 202*b* representing five elapsed months, and the secondary month symbol 204*b*, depicted as one of Saturn's moons and corresponding to a single elapsed month. Since two Saturn symbols 202*b* and two moons 204*b* appear in the display, the corresponding month is the twelfth month, December.

In FIG. 2A, the display elements corresponding to the date include the primary date symbol 192*b*, depicted as the swimming man stick figure, each element of the stick FIG. 192*b* corresponding to five elapsed days, and the secondary date symbol 194*b*, depicted as flying fish, each flying fish corresponding to one elapsed day. Since the primary date symbol 192*b* includes five stick elements (the head, three arm elements, and one leg element) and four flying fish, the date shown in FIG. 2A is the $29^{th}$ of the month.

The time displayed in FIG. 2A is 12:59. The time elements include the primary hour display element 152*b*, depicted as a wave or ripple in a body of water, each ripple 152*b* corresponding to one elapsed hour; the primary minutes display element 162*b*, depicted as a large star in the Figure with each light ray or stick emanating from the center of the star representing five minutes; and the secondary minutes display element 164*b*, depicted as a small star in the Figure, each small star 164*b* representing a single elapsed minute. Since there are twelve ripples 152*b*, three large stars 162*b* exhibiting eleven light rays, and four small stars 164*b* shown on the display 142*b* in FIG. 2A, the time represented is twelve hours and fifty-nine minutes.

As shown in FIG. 2A, the display elements may cooperate to form a graphical image, such as the man swimming under the heavens accompanied by flying fish. FIG. 2A also illustrates that the display elements used to show the date are not required to be exhibited adjacent to each other, nor are the display elements used to show the time required to be grouped together. It is sufficient that the user understand the significance assigned to each symbol.

FIG. 2A also illustrates that the symbols designating the hours and minutes are not required to be shown in a conventional clockwise rotation. Again, it is sufficient that the user understand the significance assigned to each symbol. Although the symbols shown in FIG. 2A are differentiated on the basis of shape, it will be obvious to those skilled in the art that the display elements may alternatively be differentiated on the basis of color, light intensity, or any other visual characteristic.

Figure 3:
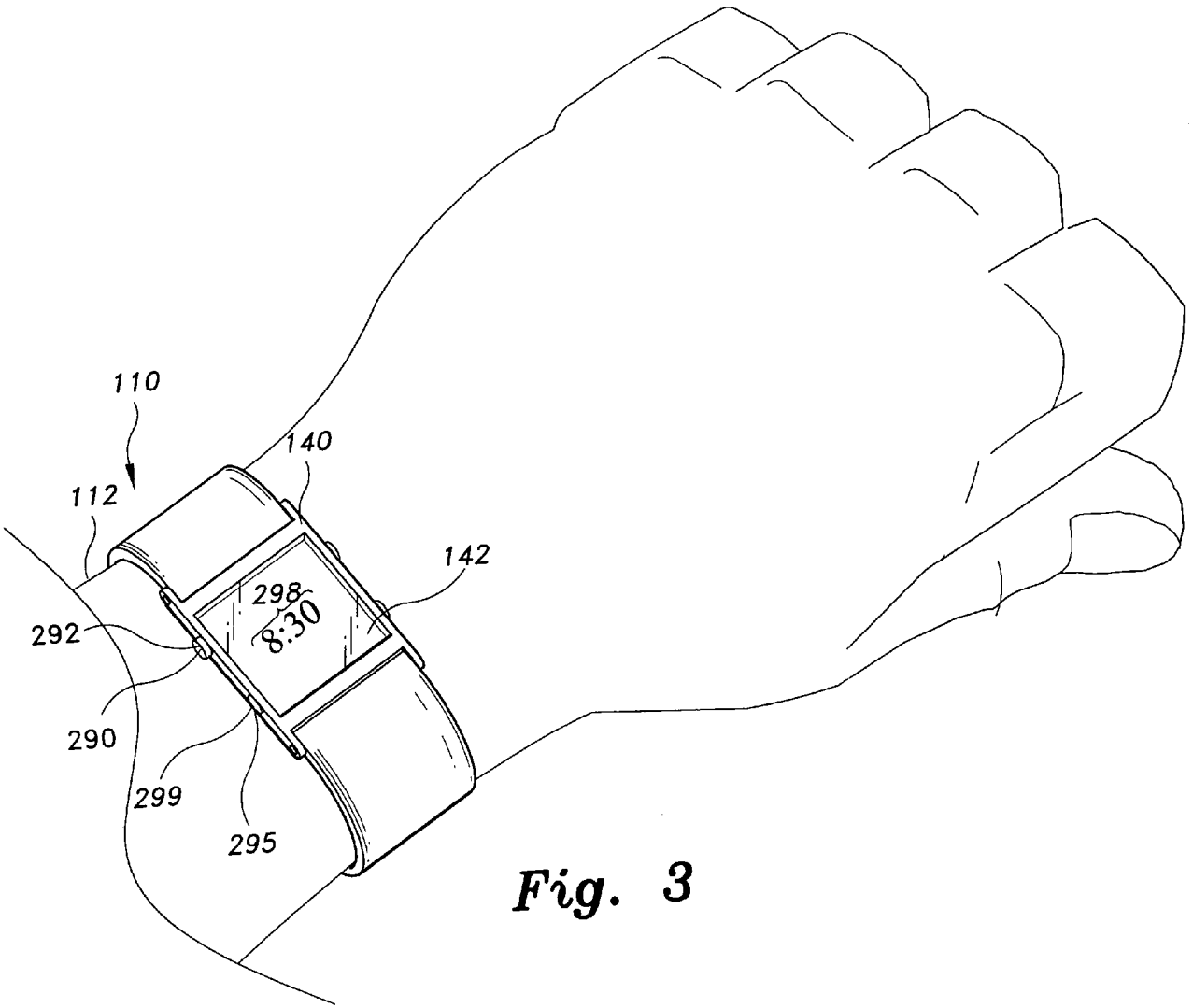
FIG. 3 is an environmental, perspective view of the device of FIG. 1 displaying time in a numerical or digital pattern.

Furthermore, as shown in FIGS. 1 and 3, the interface 130 may be, or include, a time display toggle member 295 that is able to be placed by the operator 112 in either of a first position 297 and a second position 299. When the time display toggle member 295 is in the first position 297, a first display of at least one of the group patterns, such as the hours group pattern 230 and minutes group pattern 240, is displayed or shown. When the time display toggle member 295 is in the second position 299, a second display of a numerical time pattern 298 is displayed or shown.

Figure 16:
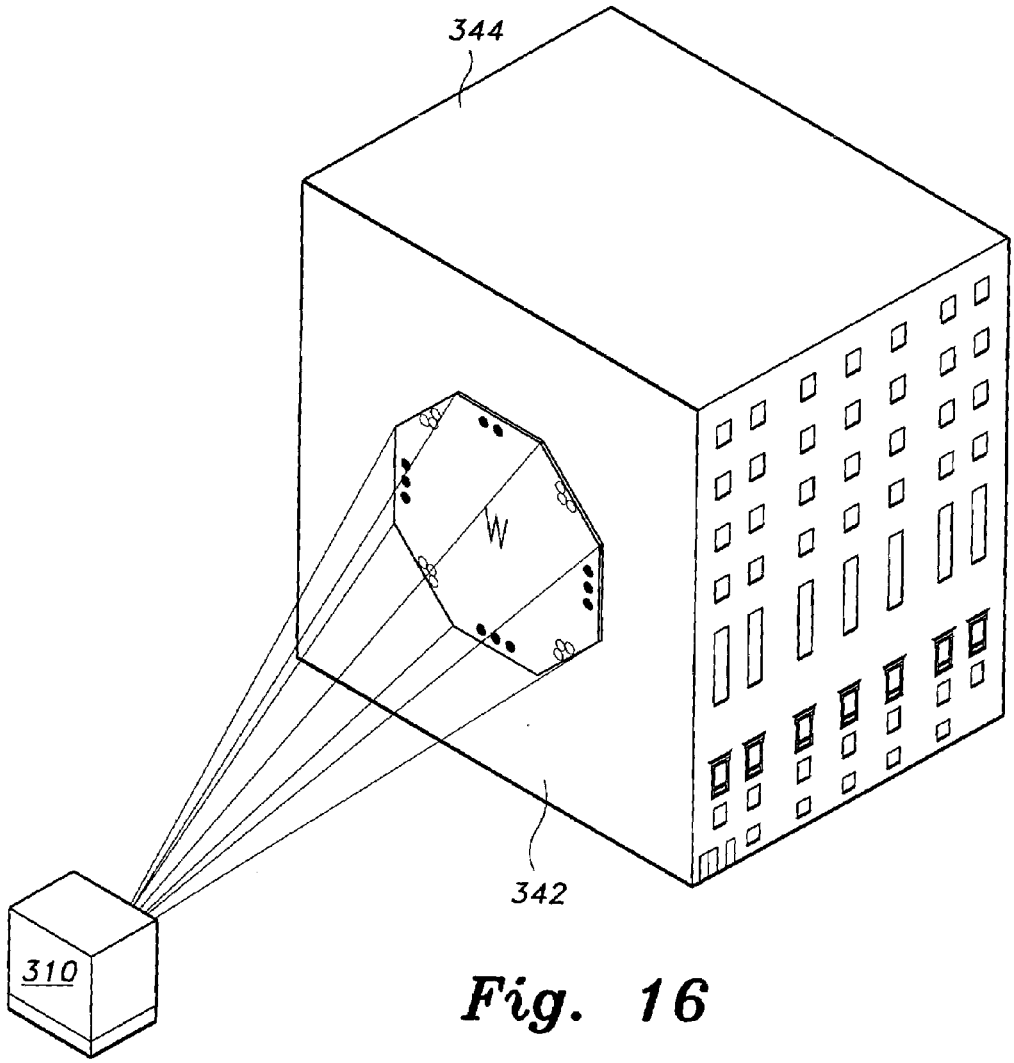
FIG. 16 is an environmental, perspective view of another embodiment of the device for displaying time according to the present invention, as a projection device displaying time in the form of an hours group pattern and a minutes group pattern of a selectable display pattern.

In a second embodiment of the present invention, shown in FIG. 16, the device 310 includes the storage device 120, the interface 130, the plurality of display elements 150,160, 170,180,190,200, and the display elements controller 210. The device 310 of the second embodiment differs from the device 110 of the first embodiment in that the device 310 of the second embodiment does not include the housing 140. An example of the device 310 is a projection device that is adapted for projecting an image of the selected selectable display pattern on a display area 342 of a structure, such as a blank billboard, a screen, a wall, or a side of a building 344.

Further, the device 110,310 of the present invention is flexible in that it allows the operator 112 and/or manufacturer to select another selectable display pattern when a different display pattern to be displayed is desired. This may be done through a software, hardware, a mechanical interface, or any other means or method known in the art.

In addition, mixing of traditional representations of time and the newly proposed representation of time is possible. Also, simultaneous representation of traditional and the newly proposed representations of time is possible.

It is to be understood that the present invention is not limited to the embodiments described above, but encompasses any and all embodiments within the scope of the following claims.

I claim:

1. A time display device for displaying time in a selectable display pattern, comprising:

a time mechanism;

a storage device for storing a plurality of selectable display patterns;

an interface receiving at least one input from an operator, said interface selecting one of said selectable display patterns in response to the at least one input;

said interface including a pattern toggle member adapted to be placed in a first position and a second position;

wherein said first position of said toggle member selects a first image display, and said second position of said toggle member selects a second image display;

a display having a display area and a plurality of display elements located proximate to said display area;

said plurality of display elements including a plurality of time and a plurality of date elements;

said plurality of time elements including a plurality of minute display elements, and a plurality of hour display elements;

each one of said plurality of minute display elements having at least an exhibiting state and a non-exhibiting state, and indicating at least one elapsed minute;

wherein an amount of said minute display elements in said exhibiting state indicating an elapsed number of minutes in an hour;

each one of said plurality of hour display elements having at least an exhibiting state and a non-exhibiting state, and indicating at least one elapsed hour;

wherein an amount of said hour display elements in said exhibiting state indicating an elapsed number of hours in a day;

said plurality of date elements including a plurality of day display elements, and a plurality of month display elements;

each one of said plurality of day display elements having at least an exhibiting state and a non-exhibiting state, and indicating at least one elapsed day in a month;

wherein an amount of said date display elements in said exhibiting state indicating an elapsed number of days in a month;

each one of said plurality of month display elements having at least an exhibiting state and a non-exhibiting state, and indicating at least one elapsed month;

wherein an amount of said month display elements in said exhibiting state indicating an elapsed number of months in a year; and a display elements controller in communication with said time mechanism, said storage device, and said interface;

said display elements controller receiving time signals from said time mechanism and in response to the time signals said controller outputs display control signals to said hour display elements and said minute display elements;

said display elements controller operably communicates with said hour display elements and said minute display elements;

said display elements controller switches each of said hour display elements and said minute display elements at least between respective said exhibiting state and said non-exhibiting state;

whereby an hours group pattern and a minutes group pattern of said one of said selectable display patterns are exhibited proximate to the display area, respectively;

said display elements controller also operably communicates with said day display elements and said month display elements;

said display elements controller switches each of said day display elements and said month display elements at least between respective said exhibiting state and said non-exhibiting state;

whereby a days group pattern and a months group pattern of said one of said selectable display patterns are exhibited proximate to the display area, respectively;

whereby a date group pattern, including said days group pattern and said months group pattern, of said one of said selectable display patterns is exhibited proximate to the display area as a result of the output display control signals from said controller in response to the time signals; and wherein each of said hours group pattern, said minutes group pattern, said day group pattern, and said month group pattern is of discrete and discernable contrast relative to the display area and is visually distinguishable from the other ones of said hours group pattern, said minutes group pattern, said day group pattern, and said month group pattern; and whereby, when said pattern toggle member is in said first position, said first image display includes at least one of said hours group pattern, said minutes group pattern, said days group pattern and said months group pattern;

whereby, when said pattern toggle member is in said second position, said second image display includes another of at least one of said hours group pattern, said minutes group pattern, said days group pattern, and said months group pattern;

wherein said first image display and said second image display are visually distinguishable from one another.

2. The device according to claim 1, wherein each of said hours group pattern and said minutes group pattern comprises a plurality of subgroup patterns wherein each of said subgroup patterns is able to be initiated by any display element within that subgroup pattern, wherein a chronological sequence of exhibition proximate to the display area among said subgroup patterns of said hours group pattern is able to be initiated by any display element within any one of said subgroup patterns of said hours group pattern, and wherein a chronological sequence of exhibition proximate to the display area among said subgroup patterns of said minutes group pattern is able to be initiated by any display element within any one of said subgroup patterns of said minutes group pattern.

3. The device according to claim 2, wherein each subgroup pattern of each of said hours group pattern and said minutes group pattern is exhibited by a group of display elements consisting of one of 2 display elements, 3 display elements, 4 display elements, 5 display elements and 6 display elements.

4. The device according to claim 1, wherein said hours group pattern and said minutes group pattern combine to form a single display pattern.

5. The device according to claim 1, wherein each of said hours group pattern and said minutes group pattern is selected from a group of group patterns consisting of one of a first group pattern of dots, a second group pattern of dots, a first group pattern of lines, a second group pattern of lines, a first group pattern of shapes and a second group pattern of shapes.

6. The device according to claim 1, wherein:

said hour display elements is selected from a group of hour display elements consisting of 12 primary hour display elements and 24 primary hour display elements wherein each primary hour display element is for indication of 1 elapsed hour, and said minute display elements is selected from a group of minute display elements consisting of 60 primary minute display elements wherein each primary minute display element is for indication of 1 elapsed minute, 12 primary minute display elements wherein each primary minute display element is for indication of 5 elapsed minutes, and 12 primary minute display elements and 4 secondary minute display elements wherein each primary minute display element is for indication of 5 elapsed minutes and each secondary minute display element is for indication of 1 elapsed minute of a 4-minute period between each 5-minute interval.

7. The device according to claim 1, wherein said storage device, said interface, said plurality of display elements and said controller are manufactured as a single operating device.

8. The device according to claim 1, wherein said plurality of display elements further comprises a plurality of second display elements located proximate to the display area, wherein each of said second display elements has at least an exhibiting state and a non-exhibiting state and is for indication of at least 1 elapsed second, wherein an amount of display elements of said second display elements being in said exhibiting state of said second display elements indicates an elapsed number of seconds in a minute, whereby said controller is in operable communication with said second display elements whereby a seconds group pattern of said one of said selectable display patterns is exhibited proximate to the display area as a result of the output display control signals from said controller in response to the time signals, and wherein said seconds group pattern is of discrete and discernable contrast relative to the display area and is visually distinguishable from said hours group pattern and said minutes group pattern.

9. The device according to claim 8, wherein:

said hour display elements is selected from a group of hour display elements consisting of 12 primary hour display elements and 24 primary hour display elements wherein each primary hour display element is for indication of 1 elapsed hour, said minute display elements is selected from a group of minute display elements consisting of 60 primary minute display elements wherein each primary minute display element is for indication of 1 elapsed minute, 12 primary minute display elements wherein each primary minute display element is for indication of 5 elapsed minutes, and 12 primary minute display elements and 4 secondary minute display elements wherein each primary minute display element is for indication of 5 elapsed minutes and each secondary minute display element is for indication of 1 elapsed minute of a 4-minute period between each 5-minute interval, and said second display elements is selected from a group of second display elements consisting of 60 primary second display elements wherein each primary second display element is for indication of 1 elapsed second, 12 primary second display elements wherein each primary second display element is for indication of 5 elapsed seconds, and 12 primary second display elements and 4 secondary second display elements wherein each primary second display element is for indication of 5 elapsed seconds and each secondary second display element is for indication of 1 elapsed second of a 4-second period between each 5-second interval.

10. The device according to claim 1, wherein said plurality of display elements further comprises a plurality of day display elements located proximate to the display area, wherein each of said day display elements has at least an exhibiting state and a non-exhibiting state and is for indication of 1 elapsed day in a week, wherein an amount of display elements of said day display elements being in said exhibiting state of said day display elements indicates an elapsed number of days in a week, whereby said controller is in operable communication with said day display elements whereby a days group pattern of said one of said selectable display patterns is exhibited proximate to the display area as a result of the output display control signals from said controller in response to the time signals, and wherein said days group pattern is of discrete and discernable contrast relative to the display area and is visually distinguishable from said hours group pattern and said minutes group pattern.

11. The device according to claim 1, further comprising a projection machine connected to said-storage device and said interface for projecting an image of said display elements on a display area.

12. A time display device for displaying time in a selectable display pattern, comprising:

a time mechanism;

a storage device for storing a plurality of selectable display patterns;

an interface receiving at least one input from an operator, said interface selecting one of said selectable display patterns in response to the at least one input;

said interface including a pattern toggle member adapted to be placed in a first position and a second position;

wherein said first position of said toggle member selects a first image display, and said second position of said toggle member selects a second image display;

a display having a display area and a plurality of display elements located proximate to said plurality of display elements including a plurality of time and a plurality of date elements;

said plurality of time elements including a plurality of minute display elements, and a plurality of hour display elements;

each one of said plurality of minute display elements having at least an exhibiting state and a non-exhibiting state, and indicating at least one elapsed minute;

wherein an amount of said minute display elements in said exhibiting state indicating an elapsed number of minutes in an hour;

each one of said plurality of hour display elements having at least an exhibiting state and a non-exhibiting state, and indicating at least one elapsed hour;

wherein an amount of said hour display elements in said exhibiting state indicating an elapsed number of hours in a day;

said plurality of date elements including a plurality of day display elements, and a plurality of month display elements;

each one of said plurality of day display elements having at least an exhibiting state and a non-exhibiting state, and indicating at least one elapsed day in a month;

wherein an amount of said date display elements in said exhibiting state indicating an elapsed number of days in a month;

each one of said plurality of month display elements having at least an exhibiting state and a non-exhibiting state, and indicating at least one elapsed month;

wherein an amount of said month display elements in said exhibiting state indicating an elapsed number of months in a year; and a display elements controller in communication with said time mechanism, said storage device, and said interface;

said display elements controller receiving time signals from said time mechanism and in response to the time signals said controller outputs display control signals to said hour display elements and said minute display elements;

said display elements controller operably communicates with said hour display elements and said minute display elements;

said display elements controller switches each of said hour display elements and said minute display elements at least between respective said exhibiting state and said non-exhibiting state;

whereby an hours group pattern and a minutes group pattern of said one of said selectable display patterns are exhibited proximate to the display area, respectively;

said display elements controller also operably communicates with said day display elements and said month display elements;

said display elements controller switches each of said day display elements and said month display elements at least between respective said exhibiting state and said non-exhibiting state;

whereby a days group pattern and a months group pattern of said one of said selectable display patterns are exhibited proximate to the display area, respectively;

whereby a date group pattern, including said days group pattern and said months group pattern, of said one of said selectable display patterns is exhibited proximate to the display area as a result of the output display control signals from said controller in response to the time signals; and wherein each of said hours group pattern, said minutes group pattern, said day group pattern, and said month group pattern is of discrete and discernable contrast relative to the display area and is visually distinguishable from the other ones of said hours group pattern, said minutes group pattern, said day group pattern, and said month group pattern; and whereby, when said pattern toggle member is in said first position, said first image display includes said hours group pattern and said minutes group pattern;

whereby, when said pattern toggle member is in said second position, said second image display includes a numerical time pattern is displayed;

wherein said first image display and said second image display are visually distinguishable from one another.

13. A time display device for displaying time in a selectable display pattern, comprising:

a time mechanism;

a storage device for storing a plurality of selectable display patterns;

an interface receiving at least one input from an operator, said interface selecting one of said selectable display patterns in response to the at least one input;

said interface including a pattern toggle member adapted to be placed in a first position, a second position, and a third position;

wherein said first position of said toggle member selects a first image display, said second position of said toggle member selects a second image display and said third position of said toggle member selects a third image display;

a display having a display area and a plurality of display elements located proximate to said display area;

said plurality of display elements including a plurality of time and a plurality of date elements;

said plurality of time elements including a plurality of minute display elements, and a plurality of hour display elements;

each one of said plurality of minute display elements having at least an exhibiting state and a non-exhibiting state, and indicating at least one elapsed minute;

wherein an amount of said minute display elements in said exhibiting state indicating an elapsed number of minutes in an hour;

each one of said plurality of hour display elements having at least an exhibiting state and a non-exhibiting state, and indicating at least one elapsed hour;

wherein an amount of said hour display elements in said exhibiting state indicating an elapsed number of hours in a day;

said plurality of date elements including a plurality of day display elements, and a plurality of month display elements;

each one of said plurality of day display elements having at least an exhibiting state and a non-exhibiting state, and indicating at least one elapsed day in a month;

wherein an amount of said date display elements in said exhibiting state indicating an elapsed number of days in a month;

each one of said plurality of month display elements having at least an exhibiting state and a non-exhibiting state, and indicating at least one elapsed month;

wherein an amount of said month display elements in said exhibiting state indicating an elapsed number of months in a year; and a display elements controller in communication with said time mechanism, said storage device, and said interface;

said display elements controller receiving time signals from said time mechanism and in response to the time signals said controller outputs display control signals to said hour display elements and said minute display elements;

said display elements controller operably communicates with said hour display elements and said minute display elements;

said display elements controller switches each of said hour display elements and said minute display elements at least between respective said exhibiting state and said non-exhibiting state;

whereby an hours group pattern and a minutes group pattern of said one of said selectable display patterns are exhibited proximate to the display area, respectively;

said display elements controller also operably communicates with said day display elements and said month display elements;

said display elements controller switches each of said day display elements and said month display elements at least between respective said exhibiting state and said non-exhibiting state;

whereby a days group pattern and a months group pattern of said one of said selectable display patterns are exhibited proximate to the display area, respectively;

whereby a date group pattern, including said days group pattern and said months group pattern, of said one of said selectable display patterns is exhibited proximate to the display area as a result of the output display control signals from said controller in response to the time signals; and wherein each of said hours group pattern, said minutes group pattern, said day group pattern, and said month group pattern is of discrete and discernable contrast relative to the display area and is visually distinguishable from the other ones of said hours group pattern, said minutes group pattern, said day group pattern, and said month group pattern; and whereby, when said pattern toggle member is in said first position, said first image display state consisting of said hours group and said minutes group for displaying time only;

whereby, when said pattern toggle member is in said second position, said second image display state consisting of said month group and said date group for displaying a date only; and whereby, when said pattern toggle member is in said third position, said third image display state consisting of said month group, said days group, said hours group and said minutes group, thereby displaying both the time and date;

wherein said first image display state, said second image display state, and said third image display state are visually distinguishable from one another.

* * * * *